US006261250B1

(12) United States Patent
Phillips

(10) Patent No.: US 6,261,250 B1
(45) Date of Patent: Jul. 17, 2001

(54) METHOD AND APPARATUS FOR ENHANCING CARDIOVASCULAR ACTIVITY AND HEALTH THROUGH RHYTHMIC LIMB ELEVATION

(75) Inventor: Edward H. Phillips, Troy, MI (US)

(73) Assignee: RLE Corporation, Troy, MI (US)

( * ) Notice: Subject to any disclaimer, the term of this patent is extended or adjusted under 35 U.S.C. 154(b) by 0 days.

(21) Appl. No.: 09/174,391

(22) Filed: Oct. 14, 1998

Related U.S. Application Data

(60) Provisional application No. 60/097,206, filed on Aug. 20, 1998, and provisional application No. 60/099,378, filed on Sep. 8, 1998.

(51) Int. Cl.[7] ..... A63B 21/04

(52) U.S. Cl. ..... 601/23; 482/121; 482/130

(58) Field of Search ..... 482/121, 123, 482/129, 130, 145; 601/23

(56) References Cited

U.S. PATENT DOCUMENTS

| | | | | |
|---|---|---|---|---|
| 4,403,773 | * | 9/1983 | Swann | 482/145 |
| 5,029,848 | | 7/1991 | Sleamaker . | |
| 5,449,336 | * | 9/1995 | Sabel | 482/130 |
| 5,496,246 | * | 3/1996 | Pierre | 482/130 |

* cited by examiner

*Primary Examiner*—Glenn Richman
(74) *Attorney, Agent, or Firm*—Gifford, Krass, Groh, Sprinkle, Anderson & Citkowski, P.C.

(57) ABSTRACT

Passive and powered RLE apparatus (10 and 80, respectively), and method for use therefor, allow and encourage safe aerobic exercise for cardiovascularly handicapped patients by partially balancing or lifting the weight of the limbs. Furthermore, during such aerobic exercise the patient's torso and head are rhythmically flooded with blood, and thus subject to varying blood pressure, as the limbs are rhythmically elevated. It is believed that this enhances cardiovascular activity and health by enabling "collateral circulation" around partially blocked arteries. The passive RLE apparatus (10) comprises an overhead anchor structure (12), and leg supporting extension springs (16) and arm supporting extension springs (18) for partially supporting the limbs via respective leg and arm supporting straps (36 and 38), and spring hooks (28) during the aerobic exercise. On the other hand, the powered RLE apparatus (80) implements rhythmic elevation of the legs and arms virtually without any effort by the patient unless he, or she, so wishes. This is enabled by a gear motor driven crank mechanism, which elevates and lowers the legs (30) and arms (32) in a nominally sinusoidal manner. Leg and arm tow lines (86 and 88) are swivelingly attached to a gear motor driven crank (90) and respectively routed through various ball bearing blocks (i.e., in a manner similar to the rigging of a sail boat) in order to lift the legs (30) and arms (32). The legs (30) and arms (32) are, in turn, coupled thereto by respective leg and arm supporting straps (36 and 38), spring hooks (28), and leg and arm lifting extension springs (82 and 84, respectively), which actually lift and lower the legs (30) and arms (32) in a rhythmic manner as the crank (90) rotates.

4 Claims, 4 Drawing Sheets

METHOD AND APPARATUS FOR ENHANCING CARDIOVASCULAR ACTIVITY AND HEALTH THROUGH RHYTHMIC LIMB ELEVATION

CROSS-REFERENCE TO RELATED APPLICATIONS

The present application draws priority from Provisional U.S. Application Ser. No. 60/097,206, dated Aug. 20, 1998, entitled "Method and Apparatus for Enhancing Cardiovascular Activity and Health Through Rhythmic Limb Elevation", and Provisional U.S. Application Ser. No. 60/099,378, dated Sep. 8, 1998, entitled "Method and Apparatus for Enhancing Cardiovascular Activity and Health Through Rhythmic Limb Elevation"

BACKGROUND OF THE INVENTION

1. Field of the Invention

The present invention relates generally to the human cardiovascular system, and more particularly to method and apparatus for enhancing blood flow through, or around, partially clogged coronary and other small arteries of the cardiovascular system.

2. Description of the Prior Art

Cardiovascular disease kills one out of two Americans. Conventional treatment tends to rely on suppressing symptoms with drugs or invasive procedures including balloon angioplasty and bypass surgery. Fortunately it is often possible to prevent, or even partially reverse, cardiovascular disease by changing one's lifestyle. For instance, avoiding smoking and following a low fat diet emphasizing fresh, whole fruits and vegetables, beans and whole grains, skinless chicken, poached fish, and the like, coupled with a reasonable exercise program, can be very helpful in this regard. In addition, there is ample evidence that the addition of nutritional supplements such as antioxidant vitamins C and E, and beta-carotene, B-complex vitamins, omega-3 fatty acids, Coenzyme Q10, L-carnitine, magnesium, DHEA and one mini-aspirin per day can help in avoiding heart attacks and in building healthy heart function.

Often, however, either because such a change in lifestyle is made too late, or simply for reasons of heredity, a comprehensive program such as outlined above may not be totally effective in reversing symptoms such as chronic angina pectoris. For those individuals who reject the conventional treatments with drugs and invasive procedures, a relatively old (e.g., dating from the 1950's) therapy known as EDTA chelation therapy is available from a handful of physicians. In spite of consistent opposition from orthodox medical circles, close to 500,000 patients have successfully undergone this therapy for cardiovascular disease.

More recently, a totally non-invasive procedure known as Enhanced External Counterpulsation (hereinafter EECP) has become available in the United States. During EECP treatments a patient lies in a prone position wearing a series of pressure cuffs around his or her calves, lower thighs and upper thighs. Then a pressure source inflates and deflates these cuffs in a sequential manner that forces blood from the legs toward the torso of the patient. The progressive inflation and deflation is electronically synchronized with the patients heartbeat via an electrocardiographic signal so that a wave of somewhat increased blood pressure arrives at the heart during diastole (e.g., when the heart is relaxing). As described in a pamphlet entitled "EECP Treatment" available from Vascomedical Inc. of Westbury, N.Y., it is believed that this may enhance "collateral circulation" of blood around blocked or narrowed arteries by opening up, or forming, tiny branches of nearby vessels. A course of EECP treatment normally comprises a series of thirty-five (35) one-hour sessions over a nominal period of seven (7) weeks.

Currently, EECP is a very exciting development. However, it also has not yet become an "orthodox" procedure and is presently available at only about forty (40) sites in the United States. Notably however, these include such prestigious sites as both medical schools of the University of California (e.g., UCSF and UCSD), New York's University Medical Center, Stoney Brook and the University of Pittsburgh Medical Center, so perhaps there is hope. On the other hand, EECP equipment is complex and its use involves electrocardiographic connection, so it must be performed under close technical and medical supervision. For these reasons, it is an expensive procedure (although it is not nearly as expensive as either of the orthodox alternatives of angioplasty or bypass surgery). Further, although it is generally performed on an out-patient basis, the fact that there are presently only forty EECP sites in the United States makes it an inconvenient choice for the overwhelming majority of Americans. It is the general object of this invention to present an alternative method and apparatus for similarly enhancing cardiovascular activity and health that is inherently even more economical and ultimately operable by the patient, without supervision, in his, or her, own home environment.

SUMMARY OF THE INVENTION

These and other objects are achieved in a method and apparatus for enhancing cardiovascular activity and health according to the present invention, in which Rhythmic Limb Elevation (hereinafter RLE) is utilized to rhythmically vary both systolic and diastolic blood pressure in the heart and generally throughout the torso, neck and head regions of the body concomitantly with the patient performing aerobic physical exercise. Systolic pressure is reached just as the heart has completed a pumping event while diastolic pressure is the resting blood pressure between pumping events.

As will be described hereinbelow, RLE apparatus comprises means for balancing or lifting the weight of the limbs. This, in turn, results in the patient being able to perform aerobic exercise at selectable intensity levels beginning at less than even the minimum level required for walking. Further, the aerobic exercise is performed with the heart at the lowest possible elevation whereat it is flooded with blood. These factors are important because as a result, RLE is a very safe way to start any patient on a program of aerobic physical exercise. This is opposed to any type of upright exercise (i.e., such as walking on a treadmill) wherein the heart is elevated and relatively starved for blood.

It has been found that individuals unable to walk aerobically without suffering unpleasant cardiovascular symptoms can easily begin a RLE exercise program leading to continuous aerobic RLE exercise, and eventually, to normal upright aerobic exercise. The pulse rate and blood pressure are minimally elevated while performing such aerobic RLE. Further, it has often been found that both systolic and diastolic blood pressure values can actually be lower immediately following RLE exercise, and still further, that these lower values may even persist between RLE exercise sessions. In any case, once a beginning level of performance is achieved, intensity levels can be gradually increased in order to achieve improving levels of cardiovasular fitness. It is believed herein that performing aerobic exercise at ever increasing intensity levels, while the heart is flooded with blood and subject to rhythmically varying blood pressure, enhances cardiovascular activity and health by enabling "collateral circulation" as described above.

The cardiovascular system is a hydraulic system subject to the same principles of hydrostatics as any other hydraulic system. Specifically, blood at the bottom of a vertical column achieves a higher pressure than that at the top of the column. In particular, blood is mostly water, the density of which is inversely related to the density of mercury by a factor of about 13. Thus, a nominally ideal systolic/diastolic pressure ratio of 120/70 mm of mercury translates to a nominally ideal systolic/diastolic pressure ratio of about 1560/910 mm of blood. If that blood pressure reading is taken at a height of about three feet, or about 915 mm off the floor, then blood pressure at the bottom of the feet must be about 2475/1825 mm of blood while at the top of the head it might only be about 950/300 mm of blood, or only 73/23 mm of mercury. This, of course, is why pilots must wear "G" suits for high performance flying, or why people sometimes feel faint if they get up too quickly. There is simply a lack of blood in the brain if the body is subject to substantial vertical acceleration.

On the other hand, consider an individual lying in a prone position with his, or her, limbs at torso height and having a pressure ratio of 1560/910 mm of blood. Should that individual then elevate all four limbs to nominally a vertical position, then it follows that the blood pressure in the limbs will drop. Because of this, and the fact that the arteries and veins are somewhat elastic and partially collapse, surplus blood flows down to the torso, neck and head where it achieves a somewhat elevated pressure and slightly stretches the arteries and veins of those regions. The average such elevation height of the limbs for a six foot tall person is in the order of 390 mm, which translates to a differential blood pressure ratio of 390 mm of blood, or about 30 mm of mercury. Since the majority of the blood capacity is in the torso, neck and head, it is probable that the majority of blood pressure variation occurs in the limbs. However, actual blood pressure measurements at torso height indicate an increase of blood pressure in the torso in the order of about 10 mm of mercury when all four limbs are elevated in this manner.

By definition, the RLE method consists of rhythmically elevating and then lowering all four limbs in a simultaneous manner at a rate of perhaps twenty to thirty times a minute. The RLE method then, could be demonstrated by a prospective patient simply lying in a prone position and raising his, or her, limbs to a near verticle position at the twenty to thirty per minute rate. However, to do this for any length of time would take a superbly conditioned athlete, most certainly not a candidate for RLE.

In compliance with a preferred embodiment of the present invention however, the RLE method can be implemented by utilizing passive RLE apparatus comprising four long extension springs attached to an overhead anchor structure. The nature of the overhead anchor structure is optional of course, but herein takes the form of a simple folded piece of sheet metal anchored, in turn, to a ceiling joist, or optionally, to studs high on a wall adjacent to the ceiling. The folded piece of sheet metal comprises suitable holes for mounting to the ceiling joist or wall studs via lag bolts, and in addition, four holes for attaching the four long extension springs. In order to actually support the limbs, leg and arm supporting straps are attached to the downward extending ends of the four long extension springs. The leg supporting straps are formed in the manner of two-branched slings within which the feet and ankles are supported. The arm supporting straps are formed in the manner of miniaturized automotive pull straps. Then the patient simply hooks his, or her, fingers through the downward extending strap loops for arm support. In addition, spring hooks are utilized for attaching the four long extension springs to the four holes in the folded piece of sheet metal, and for attaching the leg and arm supporting straps to the extension springs.

The patient is pronely positioned on a supporting mat with limbs extended and the top of his, or her, head under the overhead anchor structure prior to utilizing the passive RLE apparatus. With the patient so positioned relative to the overhead anchor structure, the extension springs are chosen such that they exert an upward component of force just balancing the extremity weight of the respective ones of the patient's limbs. This typically amounts to about 12 pounds for the legs and about 1.5 pounds for the arms.

While the patient performs RLE exercise, he, or she, rhythmically elevates and lowers all four limbs at about the twenty to thirty per minute rate. This exercise rate is conducted in progressively longer durations on a nominal daily basis until exercise times last as much as 45 minutes. Then intensity levels can be raised by increasing the repetition rate, varying the spring force or by attaching wrist and ankle weights to the extremities. Utilizing the leg and arm supporting extension springs in this manner makes it possible for a prospective patient to utilize the RLE method in his, or her, own home at minimal cost.

Although the RLE method has been so utilized with considerable success, this simplified approach does have its limitations. Firstly, when such a program is used for a cardiovascularly handicapped patient, it should be conducted under medical supervision, at least in the beginning. Secondly, even with the leg and arm supporting springs, it still requires significant co-ordination and some physical effort, and may not be appropriate for an infirm patient, at least at the beginning of an RLE program.

The answer, of course, is to provide powered RLE apparatus for implementing RLE virtually without any effort by the patient unless he, or she, so wishes. The apparatus should elevate and lower both the legs and arms in a nominally sinusoidal manner such that there are brief dwell periods in the elevated and lowered positions. This has been accomplished, according to an alternate preferred embodiment of the present invention, by implementing appartus comprising four oscillatorially driven tow lines, each adapted for rhythmically elevating and lowering one of the leg and arm extremities via extension spring and spring hook coupled leg and arm supporting straps. The four oscillatorially driven tow lines are pulley supported, and are driven by a rotating crank. Although the powered RLE apparatus is capable of implementing RLE virtually without any effort by the patient, exercise intensity levels can be raised as desired through slightly lifting, or extending, the legs and arms against the compliance of the extension springs.

The task of rhymically lifting the legs and arms at the twenty to thirty per minute rate is a fairly significant one. The apparatus should be capable of moving through a range of about three feet for the legs and about half that for the arms. In addition, it should have a significant support safety factor. This requires a throw of about eighteen inches on the crank for the legs and additional apparatus for cutting that effective throw in half for the arms. This requires an overload torque rating of 1,200 in.lbs. and a maximum operating torque rating of 800 in.lbs. Allowing for reasonable drive efficiency, this requires a drive motor of about one-half horsepower. Implementation apparatus for this purpose could take many forms. However, the most straight forward configuration, and the exemplary one chosen herein, is a gear motor having an output rotational speed between 20 and 30 RPM. The gear motor is supported by a frame structure with its output shaft oriented horizontally and directly driving the crank. Then the tow lines are swivelingly coupled to the rotating crank and threaded over idler pulleys, which are also supported by the frame structure, for rhythmically elevating and lowering the legs and arms.

It is most convenient to utilize rigging methods and apparatus commonly used in sail boats for this purpose. A line of "Bullet Blocks" available from The Harken company of Pewaukee, Wis. is utilized for this task. In the powered RLE apparatus, single swivel blocks are used for routing the tow lines generally while single swivel with becket blocks direct the arm tow lines toward the arm supporting extension springs. Then single blocks are used to support the arm supporting extension springs with the returning arm tow lines tied to the beckets in order to effect the 2-to-1 reduction of arm motion with respect to the leg motion.

In a first aspect, then, the present invention is directed to passive apparatus for implementing RLE, comprising: limb supporting straps coupled to a patient's limb extremities, an overhead anchor structure positioned above the patient, and limb supporting extension springs each attached at one end to the straps, and at the other end to the overhead anchor structure for nominally balancing the weight of the patients limbs while he, or she, periodically elevates and lowers the limbs in a rhythmic manner.

In a second aspect, the present invention is directed to powered apparatus for implementing RLE, comprising: limb supporting straps coupled to the patient's limb extremities, tow lines coupled to the limb supporting straps, and means for driving the tow lines in an oscillatory manner for drivingly elevating and lowering the limbs in a periodic rhythmic manner.

In a third aspect, the present invention is directed to a particular combination of the elements identified above. More particularly, in this third aspect, the present invention is directed to powered apparatus for implementing RLE, comprising: a crank, a gear motor for rotationally driving the crank, a frame structure for supporting the gear motor, tow lines swivelingly attached to and oscillatorially driven by the crank, tow line pulleys also supported by the frame structure, limb lifting extension springs attached to the tow lines, limb supporting straps coupled to a patients limb extremities and attached to the limb lifting extension springs for drivingly elevating and lowering the limbs in a periodic rhythmic manner.

In a final aspect, the present invention is directed to a method for enhancing cardiovascular activity and health wherein apparatus for nominally supporting, or drivingly lifting, a patient's limb extremities is provided and wherein the method comprises the step of elevating and lowering the limbs in a periodic rhythmic manner while the patient's limb extremities are so nominally supported, or drivingly lifted.

The apparatus and method for implementing RLE of the present invention can be considered as being complimentary to the EECP apparatus and treatment described above in that it could be utilized after an EECP program for cardiovascular health maintenance. Because a full course of EECP treatment is so time consuming and expensive, RLE could alternately be used for finishing a course of treatment after a shortened EECP program. Or, it might be used instead of EECP. In any of these scenarios, it possesses several distinct advantages over extended utilization of the EECP apparatus and treatment described above. For example, RLE enherently comprises beneficial aerobic exercise. In addition, RLE is less expensive than EECP, both from the standpoint of initial apparatus cost and, because it can be used without instant medical supervision, in personnel costs related to actual use. In fact, the low cost nature of RLE apparatus of the present invention enables its use in the patients home. Thus, the patient can simply utilize RLE as a supplement to his, or her, normal exercise routine.

BRIEF DESCRIPTION OF THE DRAWING

A better understanding of the present invention will now be had with reference to the accompanying drawing, wherein like reference characters refer to like parts throughout the several views herein, and in which.

DETAILED DESCRIPTION OF THE PREFERRED EMBODIMENT

Figure 1B:
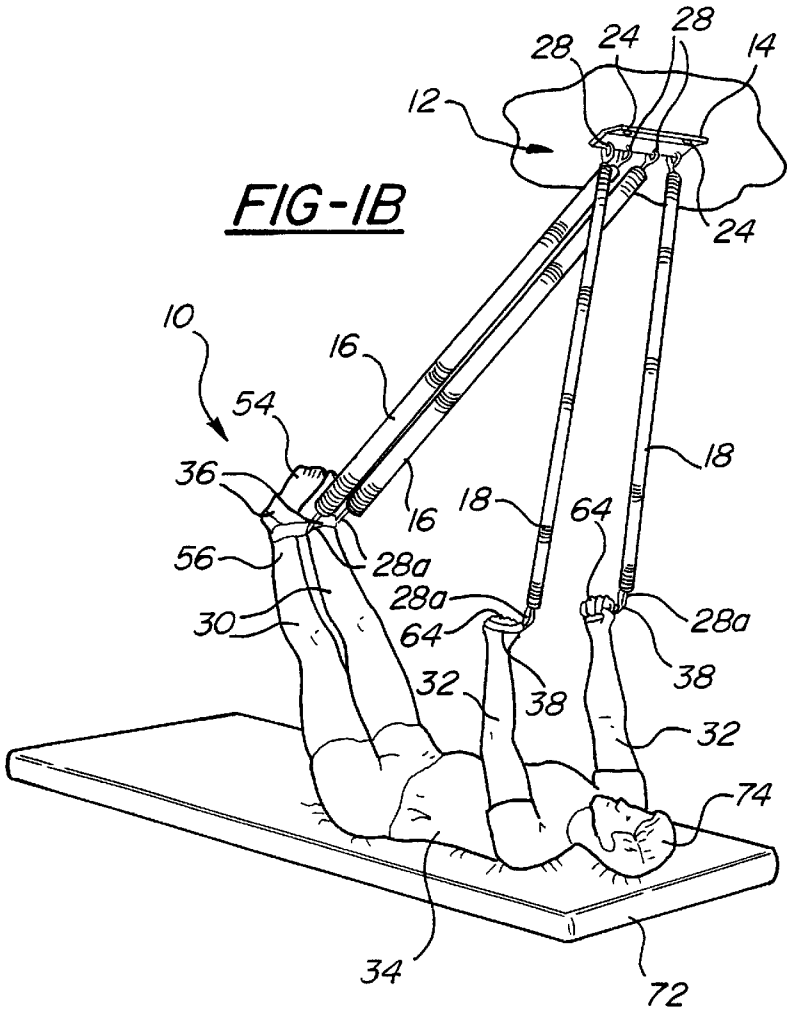
FIGS. 1A and 1B are like perspective views of passive RLE apparatus according to a preferred embodiment of the present invention wherein a patient is respectively depicted in totally prone and elevated limb positions.
Figure 1A:
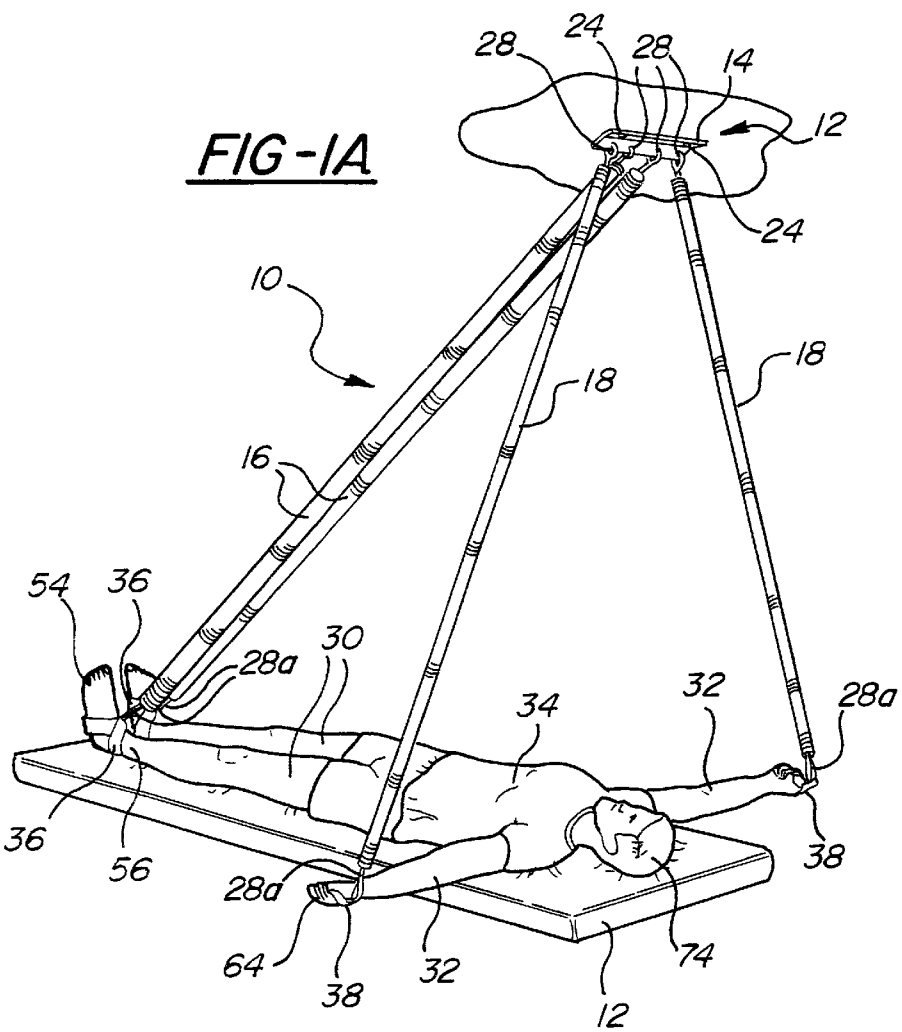

With reference first to FIGS. 1A and 1B, passive RLE apparatus 10 utilized for enabling RLE according to the present invention is thereshown in perspective views. The passive RLE apparatus 10 utilizes an overhead anchor structure 12 for locationally upholding the upper ends of leg supporting extension springs 16, and arm supporting extension springs 18. The actual means chosen for implementing the overhead anchor structure 12 is optional. However, herein it is depicted as comprising a folded sheet metal bracket 14. The folded sheet metal bracket 14 may alternately be affixed to joists supporting a ceiling, or as close to 8-feet high on studs supporting a wall (not shown) as practical.

Figure 2:
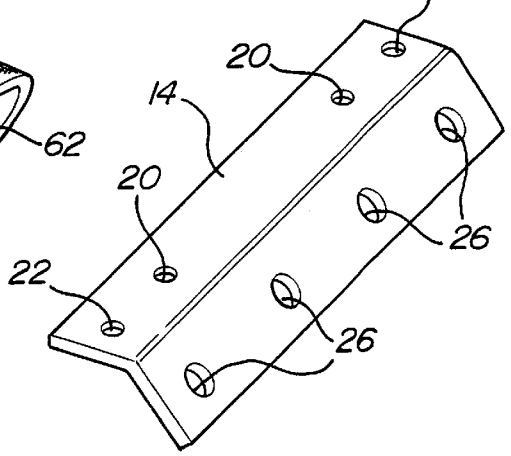
FIG. 2 is perspective view depicting a means for implementing an overhead anchor structure comprised in the preferred embodiment of the present invention.

As shown in greater detail in FIG. 2, holes 20 and 22 formed in the folded sheet metal bracket 14 are respectively utilized for supporting the leg and arm supporting extension springs 16 and 18. Lag bolts 24 are utilized for attaching the folded sheet metal bracket 14 to the ceiling, or wall (not shown), via engagement to a ceiling joist (not shown), or to wall studs (not shown), through two of holes 26 also formed in folded sheet metal bracket 14. The folded sheet metal bracket 14 is formed with an obtuse fold angle of about 120 degrees. This tends to direct the principle leg supporting force toward the lag bolts 24 in a more efficient manner regardless of whether ceiling or wall mounting is chosen. Two sets of holes 26 for mounting the lag bolts 24 are formed in the folded sheet metal bracket 14 on 12- and 16-inch centers. This allows attachment to cross-wise oriented joists, or wall studs, on any of 12-, 14- or 16-inch centers. Optionally, although not shown in FIGS. 1A and 1B, the folded sheet metal bracket could be positioned high on a wall with the lag bolts attached to wall studs. This optional mounting arrangement is useful for installation in rooms where either a very high or a false ceiling is encountered. The upper ends of the leg and arm supporting extension springs 16 and 18 are respectively coupled to the holes 20 and 22 by utilizing spring hooks 28 available from the Baron Manufacturing Co. of Addison, Ill.

Figure 3B:
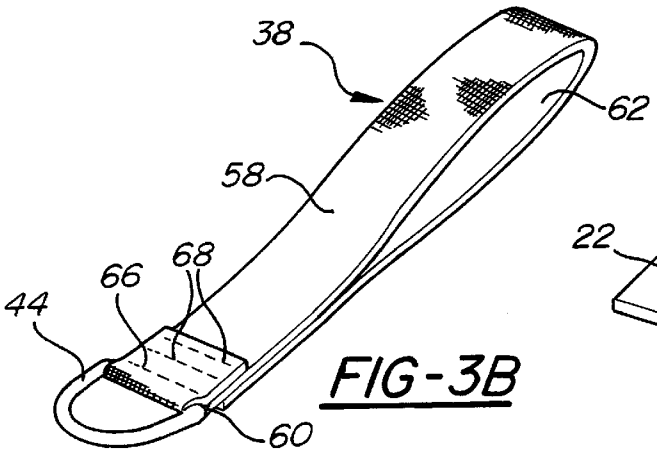
FIGS. 3A and 3B are perspective views depicting leg and arm supporting straps utilized in conjunction with both preferred and alternate preferred embodiments of the present invention.
Figure 3A:
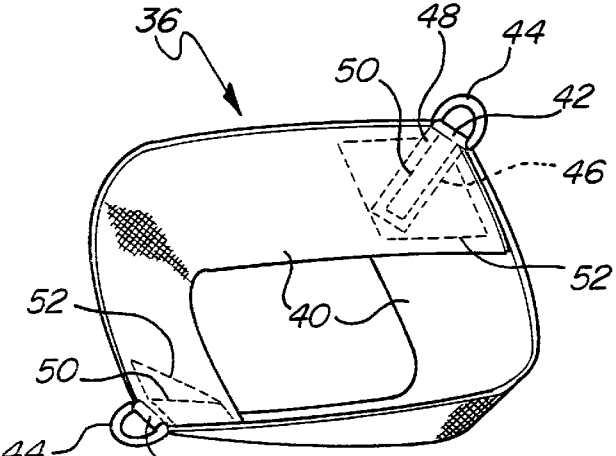

The lower ends of the leg and arm supporting extension springs 16 and 18 are respectively attached to the legs 30 and arms 32 of the patient 34 via leg and arm supporting straps 36 and 38 depicted respectively in FIGS. 3A and 3B. As shown in FIG. 3A, the leg supporting straps 36 are formed primarily from two identical 3-inch wide by 12-inch long strips 40. The strips 40 comprise neoprene foam with stretchable nylon cloth bonded to each side, which material is available from the Rubatex Corporation of Roanoke, Va. The strips 40 are cut with juxtaposed mitered edges 42 such that a "D" ring 44 can be captured in a close-coupled manner by a combining strip 46 of webbing material. The combining strip 46 is formed generally in a "U" shape capturing the "D" ring 44 and the two strips 40 overlapped at an approximate 90 degree angle. In particular, the combining strip 46 is folded in the "U" shape capturing the overlapped strips 40 and the "D" ring 44 and is securely stitched. In particular, the "D" ring 44 is captured and the combining strip 46 and strips 40 securred by stitching as indicated generally by reference numerals 50. In addition, triangular side overlapped portions of the strips 40 are also stitched as indicated by reference numerals 52.

The above described arrangement is typical on both ends of the strips 40. Thus, the leg supporting straps 36 each have two "D" rings 44 and support the foot 54 and ankle 56 of the patient 34 in a manner similar to a sling. In preparation for a RLE session the leg supporting straps 36 are left with only one of their "D" rings 44 in engagment with a leg supporting extension spring 16 via its respective spring hook 28*a*. Thus, the leg supporting straps 36 extend downwards in near enough proximity to a prone patient 34 to easily be reached by him or her. Then it is a simple matter for the patient to pull each leg supporting strap 36 down, engage it about the appropriate foot 54 and ankle 56, and capture the other "D" ring 44 with the spring hook 28*a*.

As depicted in FIG. 3B, the arm supporting straps 38 comprise a strip 58 of similar webbing material formed in a "figure 8" manner with a small loop 60 capturing another "D" ring 44 and a larger loop 62 enabling engagement by the fingers 64 of the patient 34. The strip 58 is formed in the "figure 8" manner and stitched as indicated generally by the reference numeral 68. In particular, the method used generally for capturing "D" rings 44 is by stitching as indicated by the reference numeral 66.

Again, as with the leg supporting straps 36, the arm supporting straps 38 are coupled to the arm supporting extension springs 18 via spring hooks 28*a*. However, in their non-extended state the arm supporting straps 38 are out of the patient's reach. Thus, it has been found convenient to utilize pull-down cords (not shown) tied to the spring hooks 28*a* to operatively bring the arm supporting straps 38 within reach of the patient 34. This enables the patient 34 to reach the pull-down cords (not shown) and thereby pull them and the arm supporting straps 38 down against the light tension of the shorter arm supporting extension springs 18 for engagement by the fingers 64 without assistance.

As shown in FIG. 1A, the patient 34 lies on a mat 72 with the top of his, or her, head 74 directly under the overhead anchor structure 12 and the weight of each extremity nominally supported by the respective spring force. Then the patient 34 repetitively, and in a simultaneous manner, elevates and lowers his, or her, legs 30 and arms 32 as respectively shown in FIGS. 1B and 1A, at a rate of perhaps twenty to thirty times a minute. In order to properly support the patient's lower back, it is important to utilize a mat 72 formed in a high quality resilient manner. A heavy duty 2-inch thick air matress has been found able to provide such proper support.

As is clearly shown in FIGS. 1A and 1B, both of the leg and arm supporting extension springs 16 and 18 extend at acute angles when the legs 30 and arms 32 are in prone position. Thus, the leg and arm supporting extension springs 16 and 18 must respectively exert greater tension forces than the desired nominal leg and arm vertical supporting forces of 12 and 1.5 lbs. Thus, the leg supporting extension springs 16 are each capable of exerting about 18.5 pounds of force at a full extension length of 132-inches. The leg supporting extension springs 16 are formed from 0.083-inch diameter music wire as 50-inch long, 0.949-inch diameter extension springs. The arm supporting extension springs 18 are each capable of exerting about 2.0 pounds of force at a full extension length of 120-inches. The arm supporting extension springs 18 are formed from 0.032-inch diameter music wire as 36-inch long, 0.444-inch diameter extension springs.

Figure 4A:
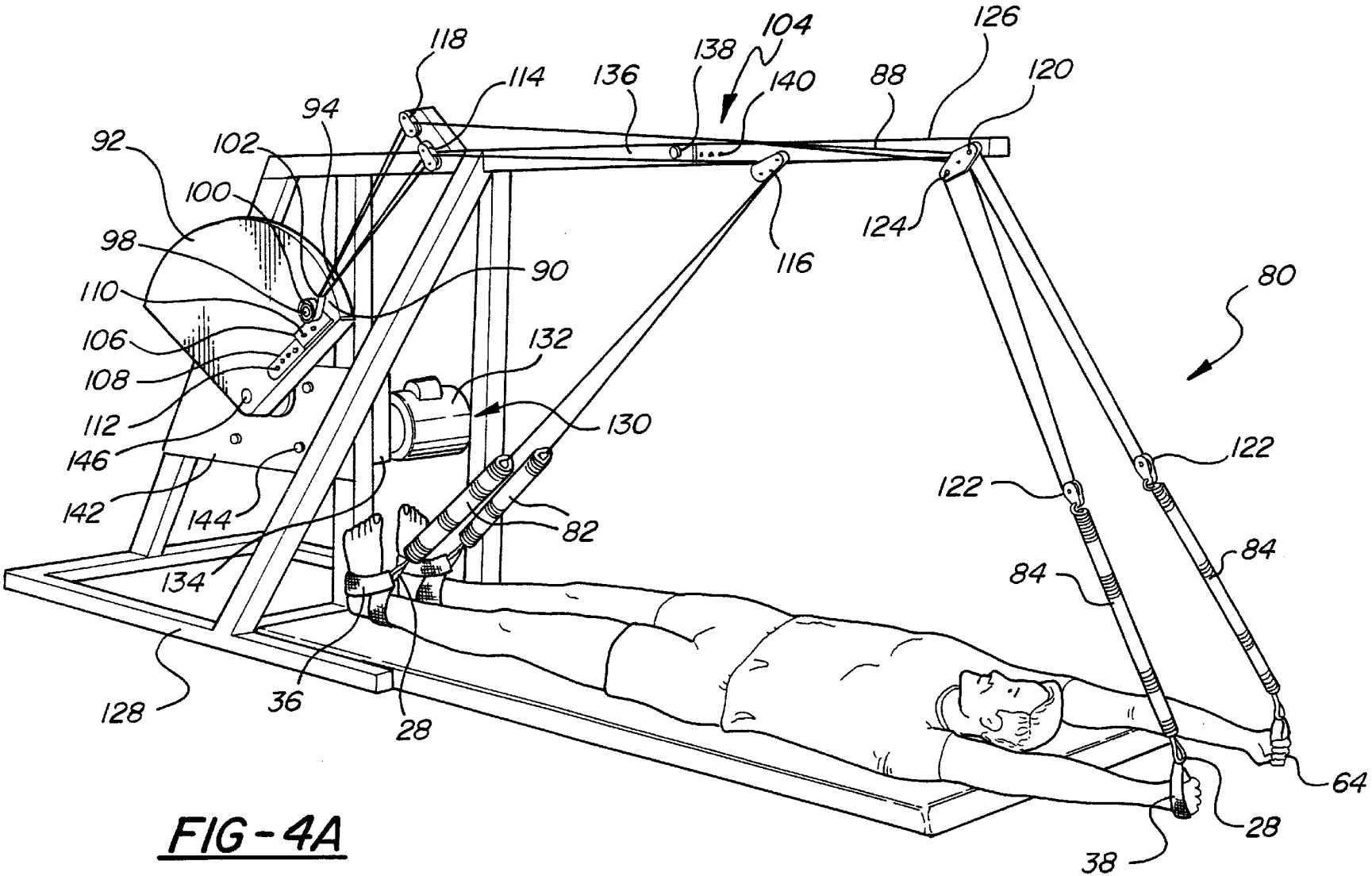
FIGS. 4A and 4B are like perspective views of powered RLE apparatus according to the alternate preferred embodiment of the present invention wherein a patient is respectively depicted in totally prone and elevated limb positions.

The RLE method consists of rhythmically elevating and lowering all four limbs in a simultaneous manner. It is begun at an initial rate of perhaps twenty times a minute for a duration of perhaps five minutes. This exercise rate is progressively increased toward the thirty times per minute rate and is conducted for progressively longer durations on a nominal daily basis until aerobic exercise times lasting as long as 45 minutes or so are achieved. Then intensity levels can be further raised by varying the spring force to lessen the support, or by attaching ankle weights (not shown) and wrist weights (not shown) to the appropriate extremities, or even by eliminating use of the arm supporting extension springs 18 altogether for a portion of the exercise period. For variation, the patient's arms 32 may be positioned "above" the head while in the prone position as is shown in FIG. 4A. (However of course, it is not possible to do this if the wall mounting option is chosen.) In any case, as the patient 34 is beginning to achieve such a level of fitness, it is recommended that normal upright aerobic exercise be introduced into a continuing health maintainance program.

In the continuing health maintainance program, it is recommended that the patient engage in both upright and RLE aerobic exercise periods lasting from 30 to 45 minutes. In order to maintain continuing cardiovascular health, both types of aerobic exercise should be conducted at this level and duration perhaps four times a week for the rest of the patient's life. However, doing both types of exercise in immediate succession has been found to be counterproductive. After all, it is believed herein that upright exercise results in a relatively elevated heart being somewhat starved for blood as opposed to RLE exercise wherein the heart is flooded with blood. Symptomatically it has been determined that the contrast involved in sequentially conducting these two fundamentally different types of exercise, in either order, may be undesirable for cardiovascularly compromised patients. Rather, it has been found optimum to first perform upright aerobic exercise and then wait at least two hours before performing RLE aerobic exercise. In any case, the inexpensive nature of the passive RLE apparatus 10 makes it possible for the patient 34 to enjoy the benefits of the RLE method on a continuing basis in his, or her, own home.

Unexpectedly, it has been found that individuals past the age of 60 may achieve an apparently superior level of cardiovascular fitness through practicing RLE than they had posessed at the age of 40. This can be ascertained objectively by comparing relative athletic performance levels vs. age graded standards for individuals who have maintained high level competitive track-and-field activities through both ages. By comparing such records vs. these individuals' performances when they were young, it appears that cardiovascular deficiencies can, and do, easily occur by age 40. On a subjective level, it has been found that inner body physical recovery times for a RLE participating athlete past the age of 60 can be reduced below those that he, or she, had experienced at the age of 40 following a similarly intense workout or competitive event. This strongly suggests that adults approaching middle age should consider themselves cardiovascularly at risk. Moreover, it only seems prudent to take preventative action, such as described herein, even though obvious cardiovascular symptoms might not be present.

Although the RLE method has been utilized as described above with considerable success, this simplified approach does have its limitations. Firstly, when utilized for significantly cardiovascularly handicapped patients, such a program should be conducted under medical supervision, at least in the beginning. Secondly, even with the leg and arm supporting extension springs 16 and 18, the procedure still requires significant co-ordination and some physical effort, and may not be appropriate for an infirm patient, at least at the beginning of an RLE program.

Figure 4B:
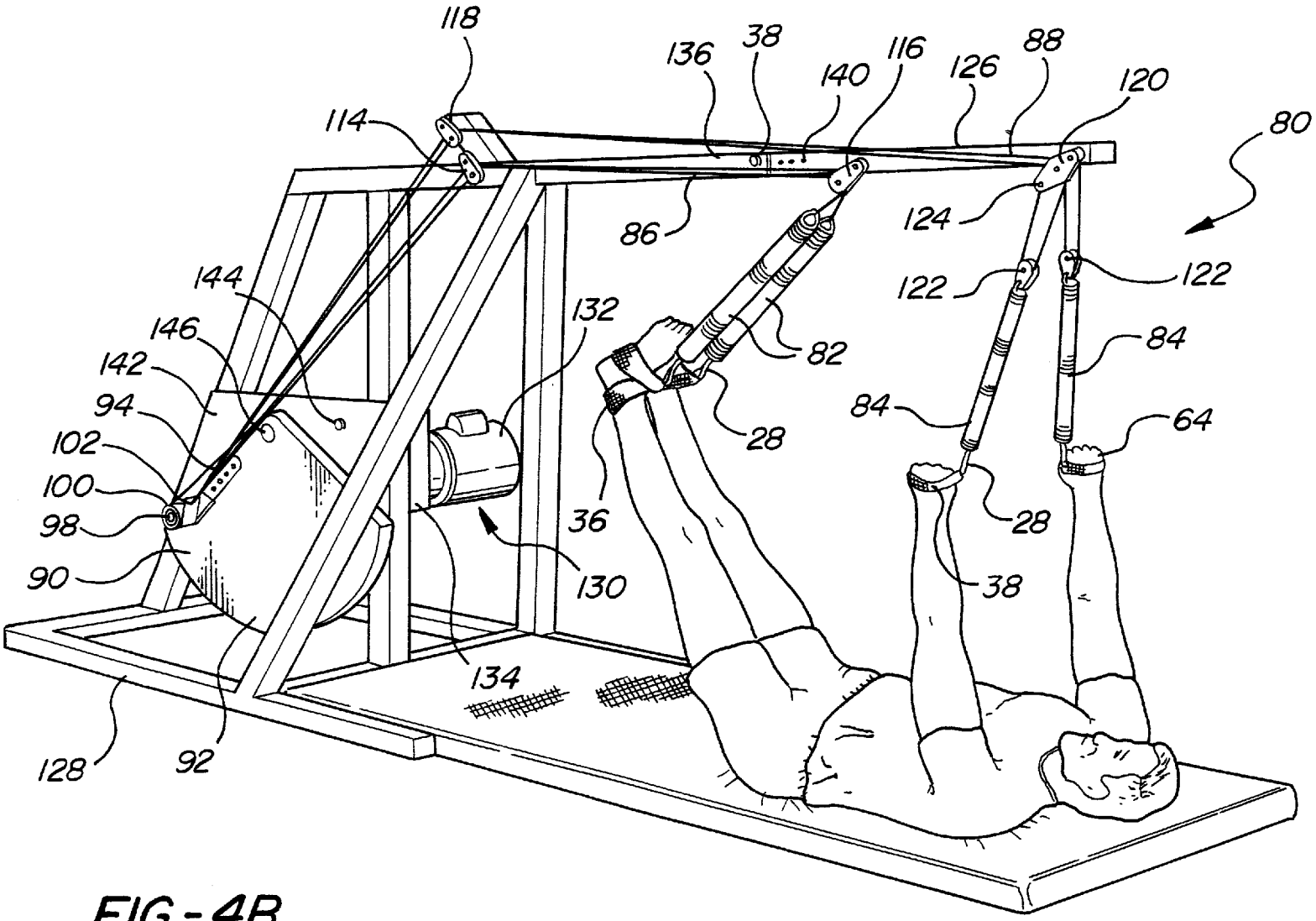

The answer, as shown in FIGS. 4A and 4B, is to provide a powered RLE apparatus 80 for implementing RLE virtually without any effort by the patient unless he, or she, so wishes. The powered RLE apparatus 80 elevates and lowers the legs, as respectively shown in FIGS. 4B and 4A, in a nominally sinusoidal manner such that there are brief dwell periods in the elevated and lowered positions. In the powered RLE apparatus 80 this has been accomplished by cyclically elevating and lowering leg and arm lifting extension springs 82 and 84, respectively, via leg and arm tow lines 86 and 88, respectively, in compliance with rotational motion of a crank 90 comprising a counterweight 92. The inboard ends 94 of the leg and arm tow lines 86 and 88 are swivelingly attached to an outboard portion of the crank 90 via pin 98, bearing 100 and clamp 102. In order to vary the stroke length and accommodate patients of varying stature, the pin 98 is attached to the outboard portion of the crank 90 via a simple slide mechanism comprising a plate 106 slidingly positioned along a groove 108 and fastened thereto by bolts 110 threadingly installed in any two of a radially oriented array of holes 112.

The leg and arm tow lines 86 and 88 are threaded through a succession of pulleys or ball bearing blocks in a manner similar to that used to rig a sail boat. Specifically, each of the leg tow lines 86 is threaded through swivel blocks 114 and 116, and coupled to a leg lifting extension spring 82. Similarly, each of the arm tow lines 88 is threaded through a swivel block 118, a swivel with becket block 120, a single block 122 and coupled to a becket 124. The single blocks 122 are coupled to arm lifting extension springs 84 whereby the arm lifting extension springs 84 have half the motion of the arm tow lines 88, and therefore, half the motion of the leg lifting extension springs 82. An extension beam 126 is utilized for mounting single swivel blocks 116 and single swivel with becket blocks 120, and is adjustably positioned in concert with varying positions of the slide mechanism 104 in order to properly position the patient's legs 30 and arms 32 on the mat 72 at the bottom of the stroke.

A frame structure 128 formed of square and/or rectangular structural steel tubing is utilized to locate and support a gear motor 130 comprising a drive motor 132 and a speed reducer 134 for rotationally driving the crank 90. The extension beam 126 is formed of slightly smaller square or rectangular structural steel tubing than the top beam 136 of the frame structure 128 and is telescopingly located therewithin by pin 138 engaging one of an array of holes 140. The patient's legs 30 are compliantly attached to the leg tow lines 86 via leg supporting straps 36, spring hooks 28 and the leg lifting extension springs 82. The patient's arms 32 are lifted by his, or her, fingers 64 engaging arm supporting straps 38 compliantly attached to the arm tow lines 88 via spring hooks 28 and arm lifting extension springs 84. The leg lifting extension springs 82 may, for instance, be formed from 0.096 inch diameter music wire as ten-inch long, 1 inch diameter extension springs. The arm lifting extension springs 84 may, for instance, be formed from 0.047 inch diameter music wire as ten-inch long, 0.75 inch diameter extension springs. The leg and arm lifting extension springs 82 and 84 are less compliant than the leg and arm supporting extension springs 16 and 18, respectively. This is because they are used for lifting the patient's legs 30 and arms 32 as opposed to merely supporting their weight as in passive RLE apparatus 10.

The task of rhymically lifting the legs 30 and arms 32 at the twenty to thirty per minute rate is a fairly significant one. The leg and arm tow lines 86 and 88 should be capable of moving through a range of about three feet and the gear motor 130 should be of robust design in order to present a significant support safety factor. This requires a throw of about eighteen inches on the crank 90 with an overload torque rating of 1,200 in.lbs for the speed reducer 134 and a maximum operating torque rating of 800 in.lbs. for the speed reducer 134 as driven by the gear motor 130. Allowing for an output rotational speed between 20 and 30 RPM, and reasonable drive efficiency, this requires the drive motor 132 to have an output power rating of about one-half horsepower.

The gear motor 130 is fixedly secured to a plate 142, comprised in the frame structure 128, by bolts 144 with its output shaft 146 oriented horizontally for directly driving the crank 90. In FIGS. 4A and 4B the gear motor 130 is depicted as comprising a single phase capacitor start drive motor 132 and a double reduction worm gear speed reducer 134. The gear motor 130 can, for instance, comprise reducer number 237DCR-L75E and motor WD3613 available from the Browning Manufacturing Division of Emerson Electric Co. of Maysville, Ky. That reducer has a rating of 1225 in.lbs. of output torque and, as driven by that motor, has a continuous output torque rating of 815 in.lbs. and a rotational speed of 23.3 RPM.

Figure 5D:
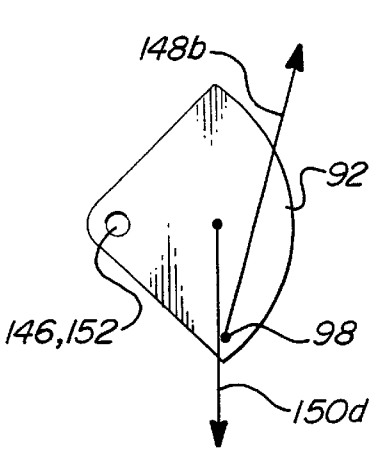
FIGS. 5A through 5D are plan views depicting crank loading of the powered RLE apparatus of FIGS. 4A and 4B through a complete cycle of leg elevation and lowering.
Figure 5C:
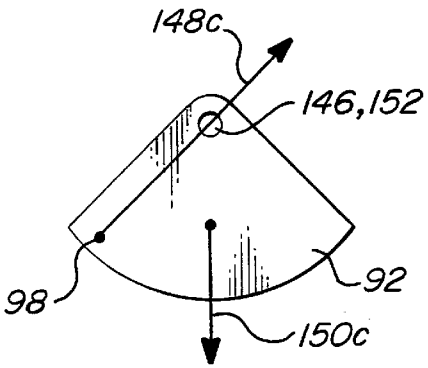
Figure 5B:
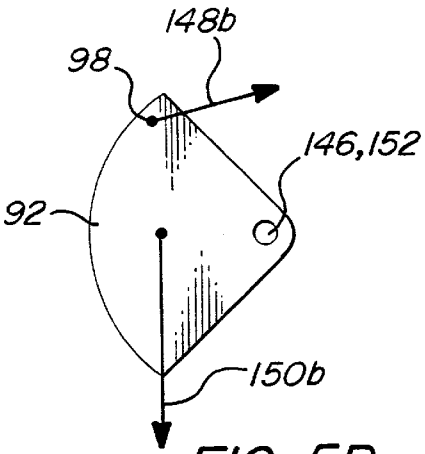
Figure 5A:
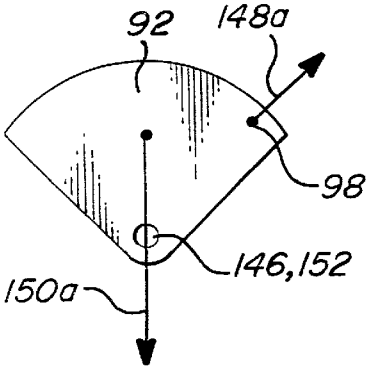

As shown particularly in FIGS. 5A–D, the pin 98 is mounted almost completely to one side of the counterweight 92. The counterweight 92 is formed in this manner because the pulling directions of the leg and arm tow lines 86 and 88 are partially toward one side (e.g., toward the single swivel blocks 114 and 116). Sequentially, FIG. 5A depicts orientation of the crank 90 at the start of rotation whereat the legs 30 and arms 32 are in a prone position. Arrow 148*a* indicates the general leg and arm supporting force direction while arrow 150*a* indicates the counterweight force direction. In this case, both arrows are in line with rotational axis 152 of the output shaft 146 so neither contributes a torque moment to the output shaft 146. In FIG. 5B on the other hand, corresponding arrows 148*b* and 150*b* extend in directions having significant deviation from that in line condition and each contribute significant torque moments to the output shaft 146. However, these moments oppose one another and the counterweight at least partially balances the leg and arm supporting force. Similarly, when the legs 30 and arms 32 have reached their uppermost elevation, as required by the orientation of the crank 90 shown in FIG. 5C, the arrows 148*c* and 150*c* are again in line with the rotational axis 152 and there are no torque moments. Finally, with the legs and arms on the way back down, as indicated by the orientation of the crank 90 shown in FIG. 5D, the torque moments are each imposed in nominally inverted directions from those indicated in FIG. 5B, and thus, are again at least partially balanced.

Practicing the RLE method with the powered RLE apparatus 80 consists of rhythmically elevating and lowering all four limbs in a simultaneous manner at the rate determined by the rotational speed of the crank 90. As the RLE program progresses, the patient is encouraged to partially lift his, or her, legs 30 and arms 32 against the compliance of the leg and arm lifting extension springs 82 and 84 on the upstroke of the leg and arm tow lines 86 and 88, and similarly, to partially drive his, or her, legs 30 and arms 32 downward against the compliance of the leg and arm lifting extension springs 82 and 84 on the downstroke of the leg and arm tow lines 86 and 88. Eventually, this is extended to a full aerobic exercise program comprising normal upright exercise such as that described above.

Of course, RLE programs for the cardiovascularly handicapped should be initiated under close medical supervision in either a medical clinic or physical therapy center whereat the powered RLE apparatus 80 would initially be utilized. Then as the patient's cardiovascular and other physical health progressed, he, or she, could be introduced to the passive RLE apparatus 10 in preparation for use thereof in his, or her, own home. Then finally, the patient would acquire a passive RLE apparatus 10 of his, or her, own for continuing, and unsupervised, use in the home as is described above. On the other hand, should any particular patient be unable to effectively make use of a passive RLE apparatus 10 or simply prefer the powered RLE apparatus 80, then that patient could acquire a powered RLE apparatus 80 for continuing use in the home.

Again, the RLE method, as well as the passive RLE apparatus 10 and the powered RLE apparatus 80 of the present invention, possess numerous advantages over the EECP apparatus and treatment described above. The primary advantages relate to the enablement of aerobic exercise, cost and availability. Either of the passive RLE apparatus 10 and the powered RLE apparatus 80 can be made directly available to the patient for use in his, or her, own home at costs below even a single seven week course of EECP treatment. This is, of course, especially true with regard to the passive RLE apparatus 10 whose cost is less than even a typical simple home exercise appartus, and thus, quite nominal. This means that the patient can indefinitely enjoy the benefits of RLE at no additional cost, and particularly, do so without the cost of continuing direct medical supervision. Further, RLE constitutes a virtually stress-free, beginning (as well as continuing) aerobic exercise program that is inherently safer (e.g., even with reference to walking) because the heart is flooded with blood and is execised at lower pulse rates and blood pressures.

Having described the invention, however, many modifications thereto will become immediately apparent to those skilled in the art to which it pertains, without deviation from the spirit of the invention. This is especially true with regard to utilization of the gear motor 130 for driving the crank 90. Clearly all manner of reducing belt drives, or even hydraulic or compressed air drives could be utilized instead. Such modifications fall within the scope of the invention.

INDUSTRIAL APPLICABILITY

The instant RLE apparatus is capable of providing improved cardiovascular health at significantly reduced costs to a significant portion of the population, and accordingly finds industrial application in the health industry both in America and abroad.

I claim:

1. A powered RLE apparatus (80) for use with a patient to implement RLE, comprising:

a crank (90);

a gear motor (130) for rotationally driving the crank;

a frame structure (128) for supporting the gear motor;

first and second tow lines (86 and 88, respectively) swivelingly attached to and oscillatorially driven by the crank;

first and second tow line pulleys (114 and 116, respectively) for directionally supporting the first tow lines, the first and second pulleys being supported by the frame structure;

third and fourth tow line pulleys (118 and 120, respectively) for directionally supporting the second tow lines, the third and fourth pulleys also being supported by the frame structure;

fifth pulleys (122) being supported by the second tow line;

first limb lifting extension springs (82) attached to the first tow lines;

second limb lifting extension springs (84) attached to the fifth pulleys;

first limb supporting straps (36) attached to the first limb lifting extension springs and coupled to the patient's feet (54) and ankles (56);

second limb supporting straps (38) attached to the second limb lifting extension springs and coupled to the patient's fingers (64);

for drivingly elevating and lowering the limbs in a periodic rhythmic manner.

2. A method for enhancing a patient's cardiovascular activity and health, wherein apparatus for nominally supporting, or drivingly lifting, the patient's limb extremities is provided and wherein the method comprises the steps of:

connecting one end of each of a first pair of flexible lines to one of the arm extremities of the patient;

connecting the other ends of said first pair of flexible lines to a movable member;

connecting one end of each of a second pair of flexible lines to one of the leg extremities of the patient;

connecting the other end of each of said second pair of flexible lines to the movable member;

suspending the first and second pair of lines over the patient;

elevating and lowering the limbs in a periodic rhythmic manner while the patient's limb extremities are so nominally supported, or drivingly lifted.

3. The method of claim 2 further comprising the step of:

connecting said movable member to a motor.

4. The method of claim 3 further comprising the step of:

operating said motor to accomplish said elevating and lowering of the limbs.

* * * * *